US008920269B2

(12) United States Patent
Rager

(10) Patent No.: US 8,920,269 B2
(45) Date of Patent: Dec. 30, 2014

(54) BROADHEAD HAVING ARCUATE BLADES

(71) Applicant: Christopher Allen Rager, Townsend, MT (US)

(72) Inventor: Christopher Allen Rager, Townsend, MT (US)

(73) Assignee: Flying Arrow Archery, LLC, Belgrade, MT (US)

( * ) Notice: Subject to any disclaimer, the term of this patent is extended or adjusted under 35 U.S.C. 154(b) by 42 days.

(21) Appl. No.: 13/797,290

(22) Filed: Mar. 12, 2013

(65) Prior Publication Data

US 2013/0237350 A1 Sep. 12, 2013

Related U.S. Application Data

(60) Provisional application No. 61/609,849, filed on Mar. 12, 2012.

(51) Int. Cl.
*F42B 6/08* (2006.01)

(52) U.S. Cl.
CPC ..... *F42B 6/08* (2013.01)
USPC ..... 473/583

(58) Field of Classification Search
USPC ..... 473/578, 583, 584
See application file for complete search history.

(56) References Cited

U.S. PATENT DOCUMENTS

| | | | | | |
|---|---|---|---|---|---|
| D184,538 | S | * | 3/1959 | Santry | D22/115 |
| 3,604,708 | A | * | 9/1971 | Brozina | 473/584 |
| 3,897,062 | A | * | 7/1975 | Christensen | 473/583 |
| 5,160,148 | A | * | 11/1992 | Musacchia, Sr. | 473/584 |
| 5,257,809 | A | | 11/1993 | Carrizosa | |
| 6,319,161 | B1 | | 11/2001 | Martinez et al. | |
| 6,863,630 | B1 | * | 3/2005 | Watkins et al. | 473/583 |
| 6,887,172 | B2 | | 5/2005 | Arasmith | |
| 6,966,856 | B1 | * | 11/2005 | Hajek | 473/583 |
| 7,311,622 | B1 | * | 12/2007 | Futtere | 473/583 |
| 8,496,549 | B2 | * | 7/2013 | Couture | 473/583 |

OTHER PUBLICATIONS

Notice of Allowance in U.S. Appl. No. 29/441,340, mailed May 20, 2014, 7 pages.

* cited by examiner

*Primary Examiner* — John Ricci
(74) *Attorney, Agent, or Firm* — Lathrop & Gage LLP

(57) ABSTRACT

Embodiments of the present disclosure provide broadhead having a body portion that includes a number of slots that extend substantially along a length of the body portion. Extending from the body portion is one or more removable blades. In embodiments, each of the removable blades has an arcuate shape that causes each blade to have an inner side and an outer side with each inner side having a sharpened edge extending substantially along a front side thereof. Additionally, a base portion of each of the plurality of removable blades is configured to be received in respective slots of the plurality of slots.

30 Claims, 18 Drawing Sheets

100

100

100

100

100

100

400

400

BROADHEAD HAVING ARCUATE BLADES

CROSS-REFERENCE TO RELATED APPLICATIONS

The present application claims priority to U.S. Provisional Application No. 61/609,849 entitled Broadhead for Attachment to an Arrow, filed on Mar. 12, 2012, the aforementioned application being incorporated by reference in its entirety.

BACKGROUND

Arrows are typically comprised of an arrow shaft and an arrowhead, commonly referred to as a broadhead, that is mounted at a tip end of the arrow shaft opposite an engaging nock. Conventional broadheads are designed with straight blades that are mounted on a center ferrule. Broadheads are designed for the purpose of striking and piercing a target, such as a game animal. However, the effective cutting surface of a broadhead is limited by the length of the blades. If the blades on current broadheads are lengthened to increase their cutting surface, the broadheads become less desirable as the increased length of the blades increases the broadheads effective diameter. Additionally, a larger surface area of a broadhead may cause the flight of an arrow to be influenced by wind or other factors which may cause deviation from a linear flight path.

BRIEF SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

Embodiments of the present disclosure provide broadhead having a body portion that includes a number of slots that extend substantially along a length of the body portion. Extending from the body portion is one or more removable blades. In embodiments, each of the removable blades has an arcuate shape that causes each blade to have an inner side and an outer side with each inner side having a beveled edge extending substantially along a front side thereof. Additionally, a base portion of each of the plurality of removable blades is configured to be received in respective slots of the plurality of slots.

Another embodiment of the present disclosure provides a broadhead comprising a body portion having a plurality of arcuate shaped blades. According to embodiments, an inner side of each of the plurality of blades has a beveled edge extending substantially along a front side of the inner edge of each of the plurality of blades.

In still yet another embodiment of the present disclosure, a broadhead having a body portion is provided. A plurality of blades extend from the body portion. According to embodiments, each blade includes two opposing blade portions extending in opposite directions from a middle portion of each blade. The two opposing blade portions arcuately extend toward the other blade portion and each blade portion has an inner beveled edge.

BRIEF DESCRIPTION OF THE DRAWINGS

Further features, aspects, and advantages will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1A:
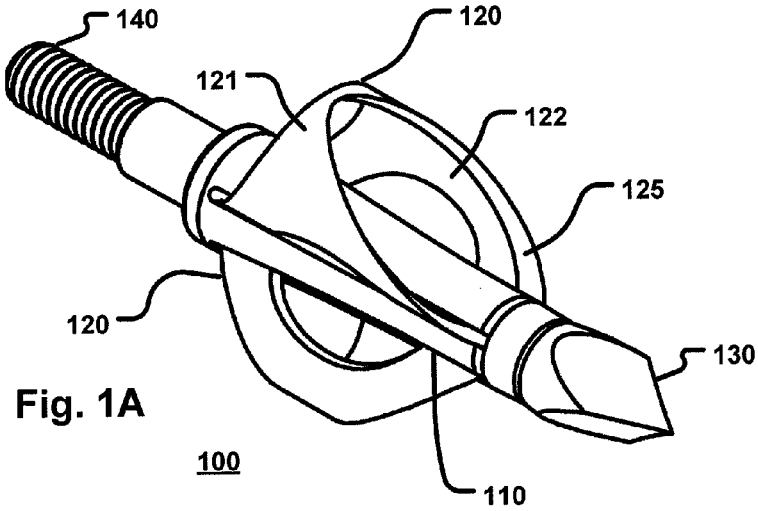
FIG. 1A is an isometric view of a broadhead according to a first embodiment of the present disclosure.

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. The following detailed description is, therefore, not to be taken in a limiting sense.

Embodiments of the present disclosure provide for a broadhead arrowhead having a body portion for attaching a plurality of arcuately shaped blades. As the blades have an arcuate shape, the overall length of the blades increases which increases the cutting surface of the blade. However, contrary to typical large diameter broadheads, the broadhead disclosed herein increases the cutting surface of the blade without increasing a side profile of the broadhead. With the increased cutting surface, the wound area on a target also increases which results in a more effective broadhead.

As will be described in more detail herein, one or more embodiments provide that the arcuate blades form complete circular shapes when viewed along the axis of an arrow shaft. In another embodiment, the arcuate blades do not form a complete circular shape when viewed along the axis of an arrow shaft. The arcuate blades of the latter embodiment may form half circular shapes or three-quarter circular shapes etc. Although specific circular shapes have been mentioned, it is contemplated that the circular shape may be any partial circular shape so as the circular shape is not completed.

In various embodiments disclosed herein, the broadhead may have two blades. In another embodiment, the broadhead may have three blades. However, although a specific number of blades is specifically mentioned and shown in the figures, it is contemplated that the broadhead of the present disclosure may have fewer or more blades than specifically mentioned. Additionally, blade types and sizes might be interchanged. For example, one embodiment may provide that two opposing blades form complete circles while a third blade forms a partial circle. In yet another embodiment, one or more linear blades could be interposed with one or more arcuate blades disclosed herein.

In yet another embodiment of the present invention, one or more blades of the broadhead may have a first straight portion and a second straight portion positioned at an angle relative to the first straight portion. The angle between the first straight portion and second straight portion could be a right angle, an obtuse angle or an acute angle. The transition between the first and second portion could be gradual, resulting in an arcuate connection between the two blades. In another embodiment, the transition between the two blades could be abrupt resulting in a sharp corner having no appearance of curvature.

Although circular shape is specifically mentioned, it is contemplated that the blades may form other shapes including ellipsis or parabolas. Additionally, it is contemplated that other known shapes may be used lower a side profile of the broadhead while increasing the length of the cutting surface. For example, linear blades could be connected to a single circular blade (arranged, for example, like the spokes of a wheel) or one or more arcuate blades could end with linear portions.

As will be discussed in more detail below, embodiments provide that the blades of and a tip of the broadhead are removable. Accordingly, the blades of the broadhead may be removed and/or replaced by removing the tip and removing/inserting replaceable blades into slots on the ferrule of the broadhead. Although slots are specifically mentioned in embodiments described herein, it is also contemplated that the blades may be secured to a ferrule using other attachment mechanisms such as bolts, glue screws and the like. In embodiments, the blades have a notch or a boss on a proximal portion that locks in under the tip when the tip is placed on the proximal end of the ferrule. Additionally, the notch of the blade may be crimped at a specific angle which may cause the blades to sit in a fixed position (i.e., not allowing the blades to rotate or misalign out of sync with one another).

Turning to the figures, FIG. 1A is an isometric view of a broadhead 100 according to a first embodiment of the present disclosure. The broadhead 100 may be comprised of a ferrule 110 with one or more blades 120 extending therefrom. Each of the blades 120 may be configured in a continuous arcuate shape such as, for example a circular shape although other shapes are contemplated. The arcuate shape of the blade 120 causes the blade 120 to have an outer side 121 and an inner side 122. In certain embodiments, the inner side 122 has a beveled/sharpened edge 125 (that forms the cutting edge of the blade) that extends substantially along a front portion of the blade 120. In another embodiment, the beveled edge 125 may be on the outer side 121. In yet another embodiment, the beveled edge 125 may be on both the inner side 121 of the blade 120 and the outer side 122 of the blade 120.

The broadhead 100 also includes a ferrule 110 from which the blades 120 extend, an end portion 140 for securing the broadhead 100 to an arrow shaft and a tip 130. With respect to the end portion 140, in certain embodiments, the end portion 140 may be threaded so as to enable the broadhead 100 to be secured to the arrow shaft. Although a threaded end portion 140 is specifically mentioned, it is contemplated that other means may be used to secure the broadhead 100 to an arrow shaft including, but not limited to glue, a snap fitting, sliding mechanism (i.e., press fitting) etc.

Figure 1B:
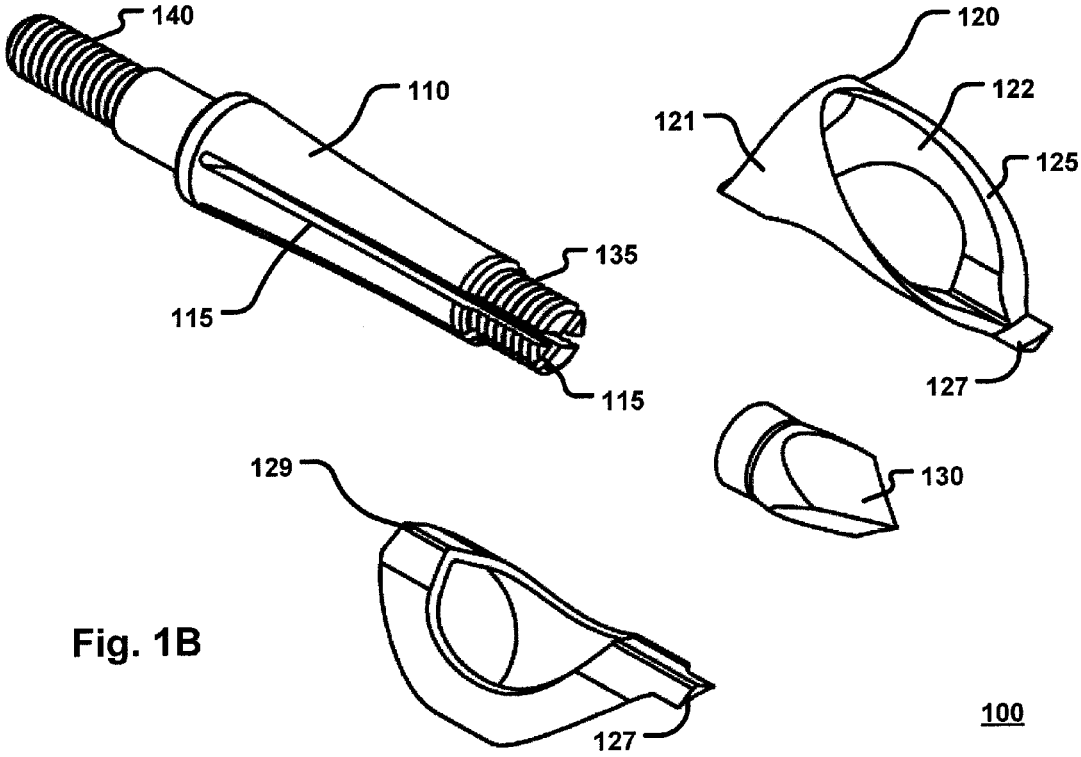
FIG. 1B is an exploded isometric view of the broadhead according to the first embodiment.

In certain embodiments, the blades 120 are integrally formed (i.e., not removable) with the ferrule 110. In another embodiment, the blades 120 are removable. In such embodiments, the tip 130 may be removed from the ferrule 110 and the blades 120 may be inserted and removed from one or more grooves or slots 115 (FIG. 1B) present on the ferrule 110. As shown in FIG. 1B, the slots 115 may begin at a proximate end of the ferrule 110 and extend substantially along a length of ferrule 110 toward a distal end of the ferrule 110. In embodiments, the length of the slots 115 may be equivalent, or substantially equivalent to the length of the blade 120. To secure the blade 120 to the ferrule 110, a securement portion 129 of the blade is inserted into the slots 115. Once the blades 120 have been inserted into the slots 115, the tip 130 may then be secured to the ferrule 115.

In certain embodiments, the proximate end of the ferrule 110 is threaded and the tip 130 may be secured to the ferrule 110 via corresponding threads on an inner portion of the tip 130. In another embodiment, the slots 115 may extend substantially along a length of the ferrule 110 from a distal end 140 toward the proximate end of the ferrule 110. In such embodiments, the blades 120 may be secured in the slots 115 when the distal end 140 of the broadhead 120 is secured into an arrow shaft.

As shown in FIG. 1B, the blade 120 may include a notch 127 on a proximate end (and/or a distal end) of the blade 120. This notch 127 may be used to further secure the blade 120 to ferrule 110. In certain embodiments, the notch 127 is configured to be inserted into the tip 130 when the tip 130 is secured to the proximate end of the ferrule 110. As also shown, the blade 120 is formed in a complete arcuate shape (shown further in FIGS. 1G and 1H) with the cutting edge of the blade positioned on the inner side 122 of the blade 120.

Figure 1C:
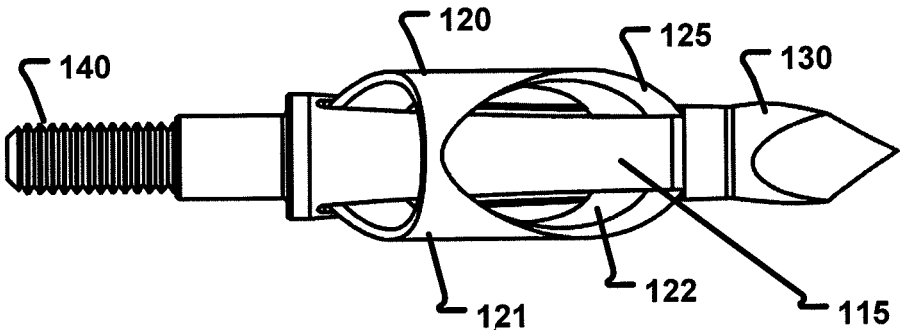
FIG. 1C is a top view of the broadhead according to the first embodiment.
Figure 1D:
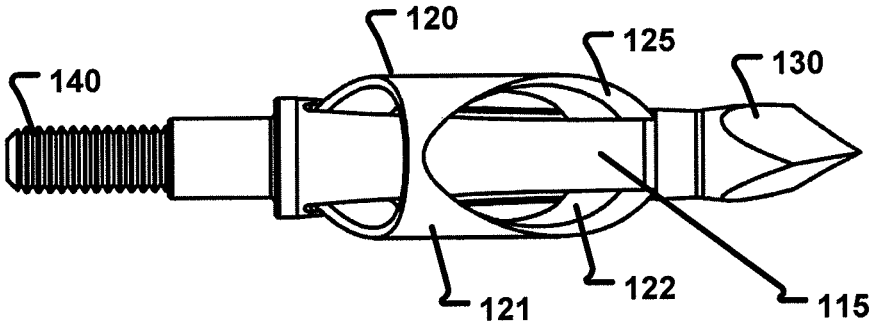
FIG. 1D is a bottom view of the broadhead according to the first embodiment.
Figure 1E:
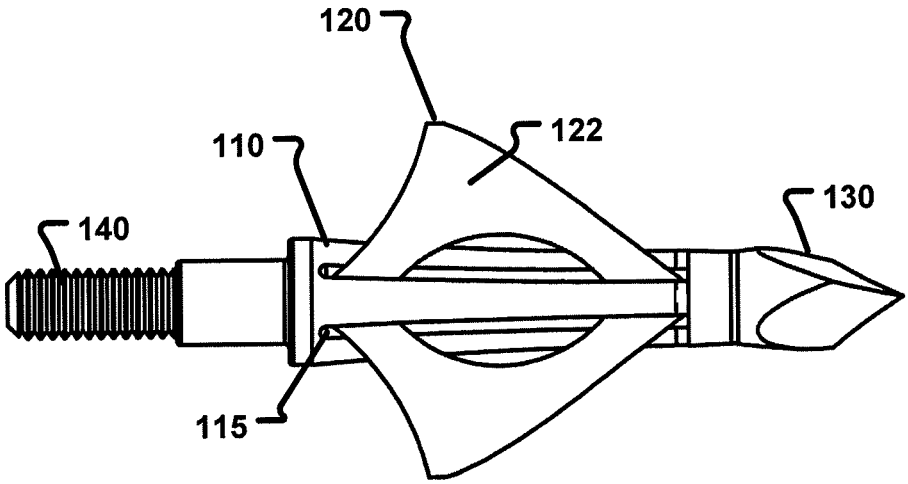
FIG. 1E is a right side view of the broadhead according to the first embodiment.
Figure 1F:
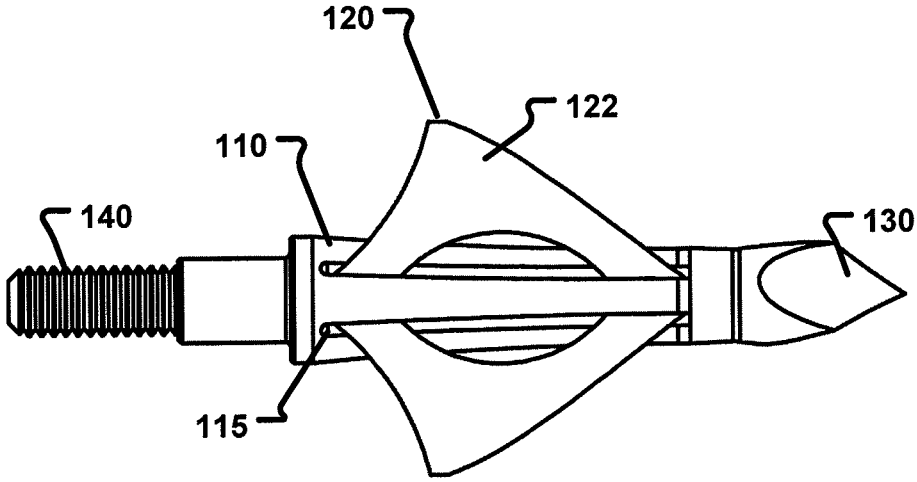
FIG. 1F is a left side view of the broadhead according to the first embodiment.
Figure 1G:
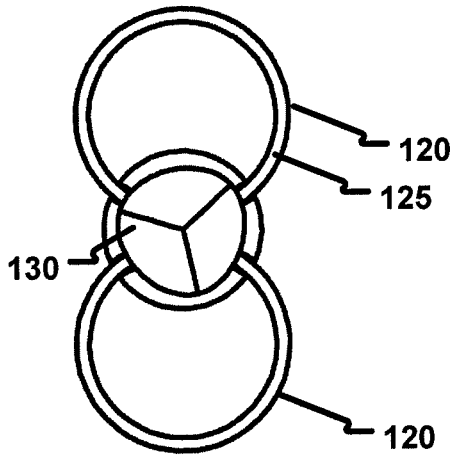
FIG. 1G is a front view of the broadhead according to the first embodiment.
Figure 1H:
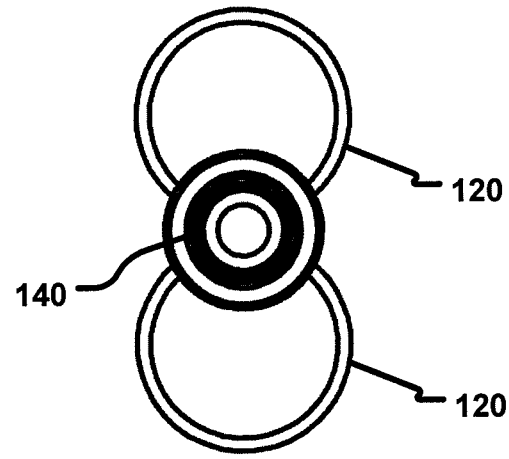
FIG. 1H is a back view of the broadhead according to the first embodiment.

FIGS. 1C-1H illustrate various additional views of the broadhead 100. Specifically, FIG. 1C illustrates a top view of the broadhead 100, FIG. 1D illustrates a bottom view of the broadhead 100, FIG. 1E illustrates a right side view of the broadhead 100, FIG. 1F illustrates a left side view of the broadhead 100, FIG. 1G illustrates a front view of the broadhead 100 and FIG. 1H illustrates a back view of the broadhead 100.

Figure 2A:
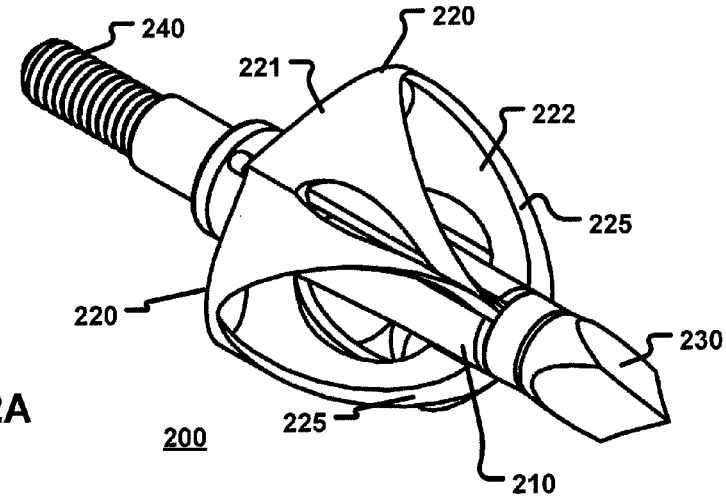
FIG. 2A is an isometric view of a broadhead according to a second embodiment of the present disclosure.

FIG. 2A is an isometric view of a broadhead 200 according to a second embodiment of the present disclosure. Like broadhead 100 (FIG. 1A), broadhead 200 includes a plurality of blades 220 that extend from a ferrule 210. The blades 220 have an arcuate shape that forms a complete circular shape which causes the blades 220 to have an inner side 222 and an outer side 221. According to embodiments, the inner side 222 has a beveled edge 225 that forms the cutting surface of the blades 220. The broadhead 220 includes a tip 230 at a proximate end and threads or other securement means at a distal end 240.

Figure 2B:
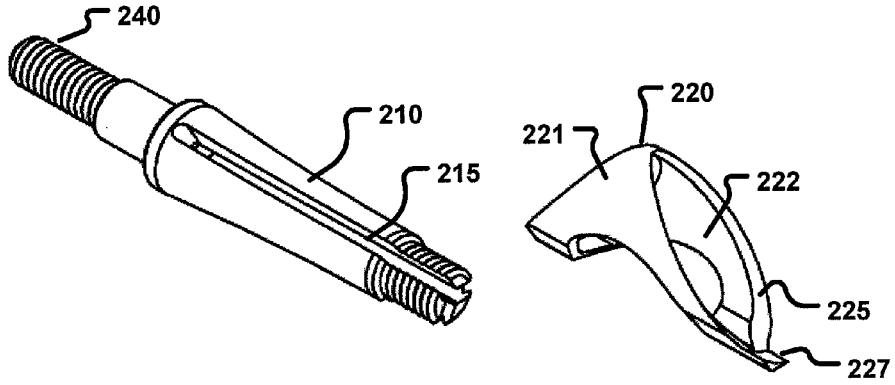
FIG. 2B is an exploded isometric view of the broadhead according to the second embodiment.
Figure 2B:
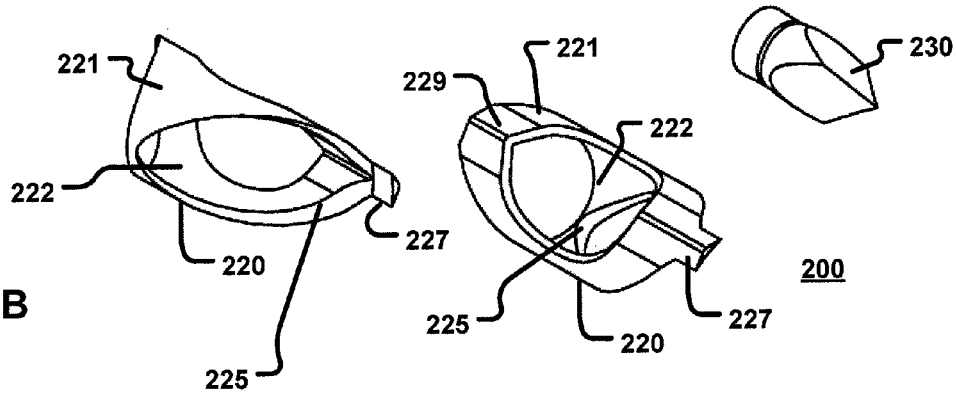

As shown in FIG. 2B, the broadhead 200 may include three blades 220 with each blade being configured to be inserted and removed from the ferrule 210 by sliding a connecting portion 229 of the blade into one or more slots 215 on the ferrule 210. Once the blades 220 have been inserted into the slots 215, a notch 227 on the blade 220 may be configured to fit within a portion of the tip 230 when the tip 230 has been secured to a proximate end of the ferrule 210 to further secure the blades 220 to the ferrule 210. When the blades 220 are secured, the blades will not move, slide or rotate within the ferrule 210.

Figure 2C:
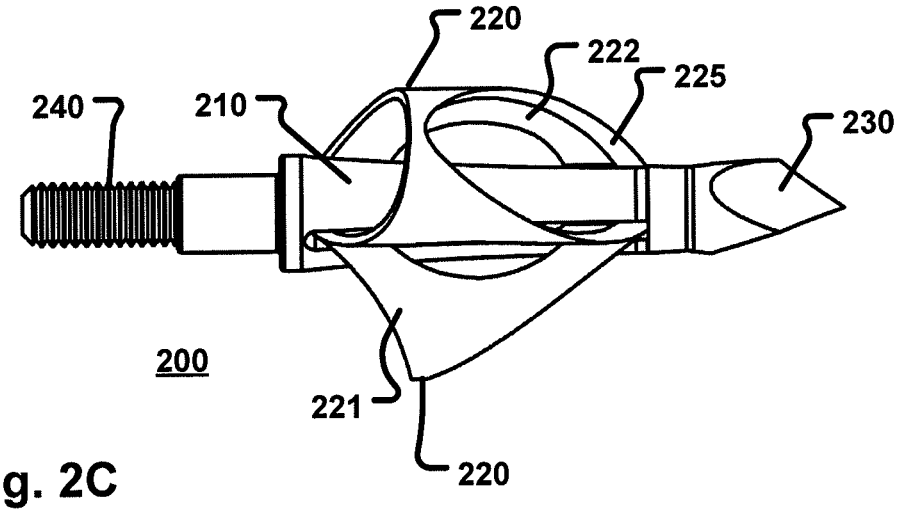
FIG. 2C is a top view of the broadhead according to the second embodiment.
Figure 2D:
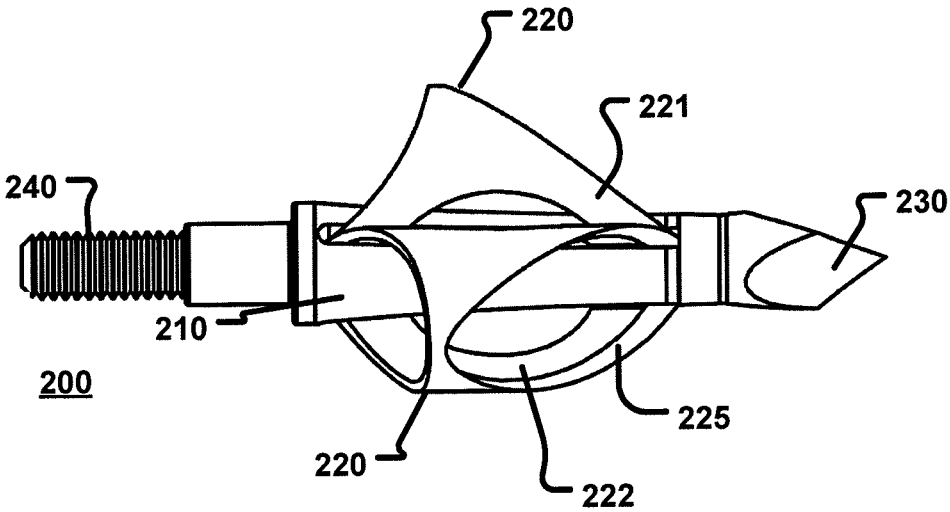
FIG. 2D is a bottom view of the broadhead according to the second embodiment.
Figure 2E:
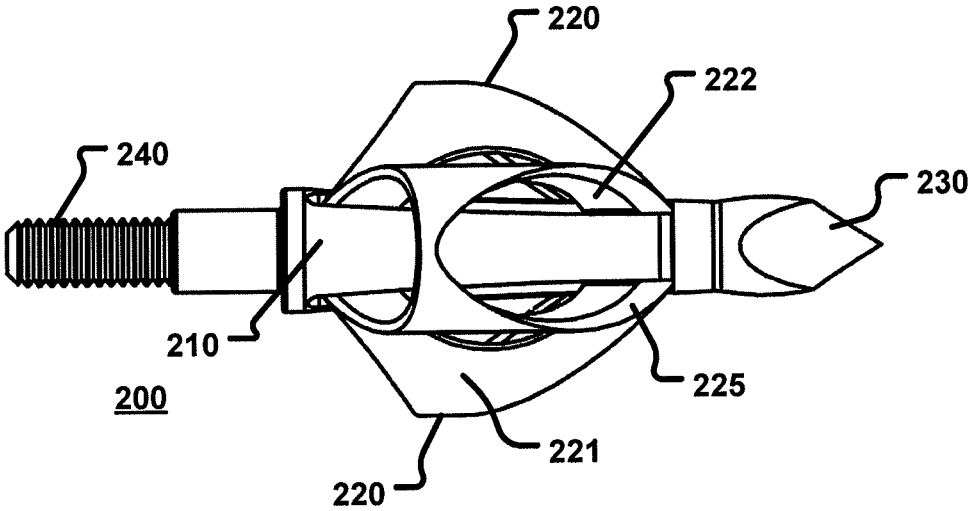
FIG. 2E is a right side view of the broadhead according to the second embodiment.
Figure 2F:
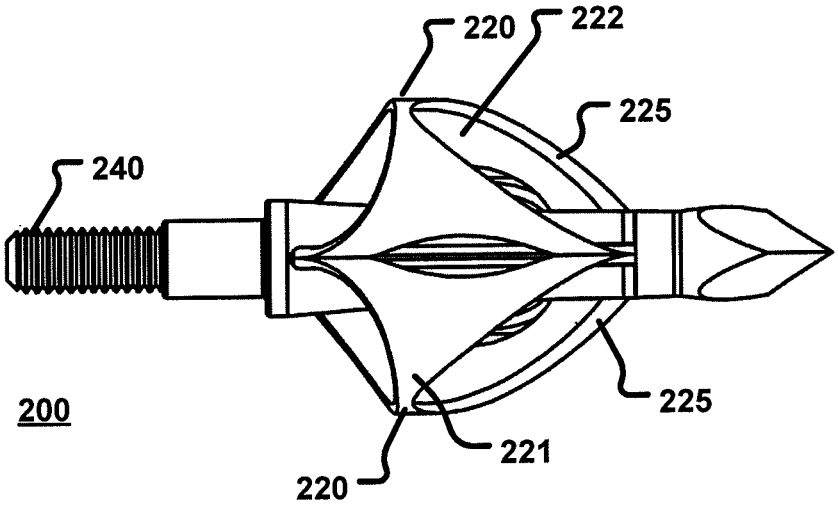
FIG. 2F is a left side view of the broadhead according to the second embodiment.
Figure 2G:
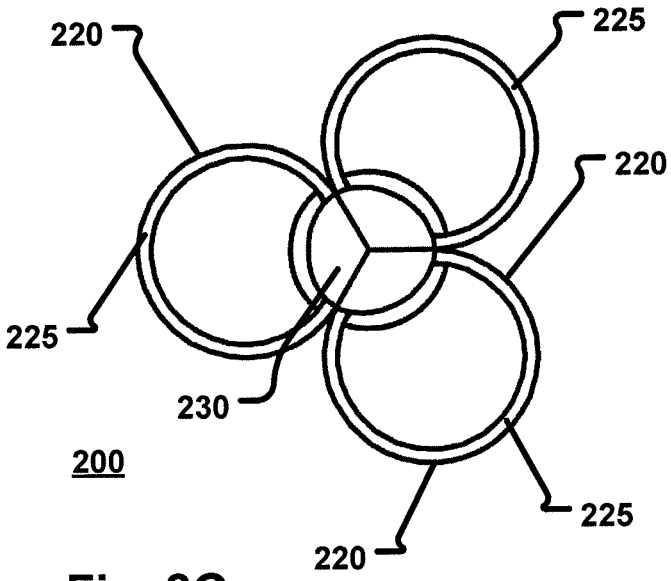
FIG. 2G is a front view of the broadhead according to the second embodiment.
Figure 2H:
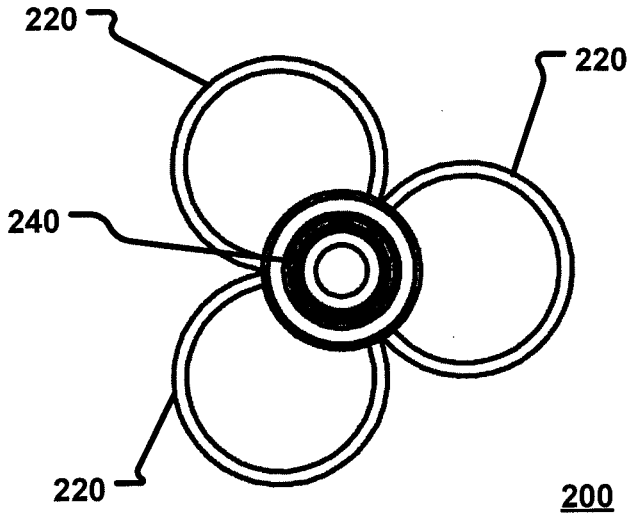
FIG. 2H is a back view of the broadhead according to the second embodiment.

FIGS. 2C-2H illustrate various additional views of the broadhead 200. Specifically, FIG. 2C illustrates a top view of the broadhead 200, FIG. 2D illustrates a bottom view of the broadhead 200, FIG. 2E illustrates a right side view of the broadhead 200, FIG. 2F illustrates a left side view of the broadhead 200, FIG. 2G illustrates a front view of the broadhead 200 and FIG. 2H illustrates a back view of the broadhead 200.

Figure 3A:
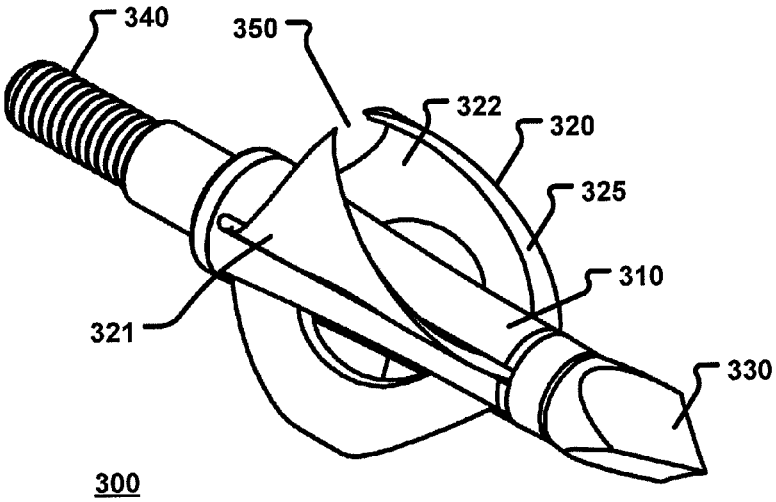
FIG. 3A is an isometric view of a broadhead according to a third embodiment of the present disclosure.

FIG. 3A is an isometric view of a broadhead 300 according to a third embodiment of the present disclosure. The broadhead 300 may be comprised of a ferrule 310 with one or more blades 320 extending therefrom. In certain embodiments the blades 320 may be integrally formed with the ferrule 310 such that the blades 320 cannot be removed. In another embodiment, the blades 320 may be removable from the ferrule 310.

Each of the blades 320 may be configured in an arcuate shape such as, for example a circular shape although other shapes are contemplated. However, unlike the broadhead 100 and 200 of FIGS. 1A and 2A, broadhead 300 includes an opening 350 along an arc of the blade 320. In certain embodiments, as air passes through the opening 350, the air causes the blades to outwardly extend. As a result of the blades 320 extending outward, the overall diameter of the impact wound is increased. In certain embodiments, the airflow through the opening 350 is increased due to the beveled edge 325 (which forms the cutting edge of the blades 320) on the inner portion 322 of the blade 320. In another embodiment, the beveled edge 325 may be on the outer side 321. In yet another embodiment, the beveled edge 325 may be on both the inner side 321 of the blade 320 and the outer side 322 of the blade 320.

As with the broadheads described above, the broadhead 300 also includes an end portion 340 for securing the broadhead 300 to an arrow shaft and a tip 330. With respect to the end portion 340, the end portion 340 may be threaded so as to enable the broadhead 300 to be secured to an arrow shaft. Although a threaded end portion 340 is specifically mentioned, it is contemplated that other means may be used to secure the broadhead 300 to an arrow shaft including such as described above with respect to FIG. 1A.

Figure 3B:
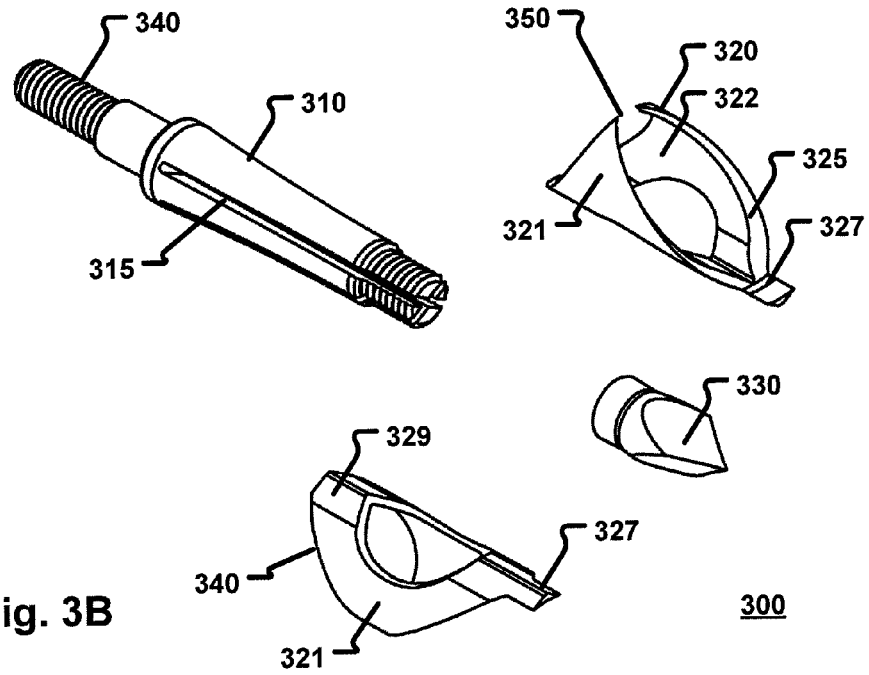
FIG. 3B is an exploded isometric view of the broadhead according to the third embodiment.

As described above, certain embodiments provide that the blades 320 may be removable. In such embodiments, the tip 330 may be removed from the ferrule 310 and one or more blades may be removed and/or inserted the slots 315 (FIG. 3B). As shown in FIG. 3B, the slots 315 may begin at a proximate end of the ferrule 310 and extend substantially along a length of ferrule 310 toward a distal end 340 of the ferrule 310.

To secure the blades 320 to the ferrule 310, a securement portion 329 of the blade 320 is inserted into the slots 315. Once the blades have been inserted into the slots 315, the tip 330 may be secured to the ferrule 315. In certain embodiments, the proximate end of the ferrule 310 is threaded and the tip 330 may be secured to the ferrule 310 via corresponding threads on an inner portion of the tip 330. In another embodiment, the slots 315 may extend substantially along a length of the ferrule 310 from a distal end 340 toward the proximate end of the ferrule 310. In such embodiments, the blades 320 may be secured in the slots 315 when the distal end 340 of the broadhead 300 is secured to an arrow shaft.

As shown in FIG. 3B, each blade 320 may include a notch 327 on a proximate end of the blade 320. This notch 327 may be used to further secure the blade 320 to the ferrule 310. In certain embodiments, the notch 327 is configured to be inserted into the tip 330 when the tip 330 is secured to the proximate end of the ferrule 310. Although a single notch is shown, it is contemplated that the notch may be placed on any portion of the blade so as to assist in keeping the blade in place. It is also contemplated that multiple notches may be used on various places of the blade 320. As also shown, the blade 320 is formed into a partial circular shape (e.g., half circle, three-quarter circle, and the like shown further in FIGS. 3G and 3H) with the cutting edge of the blade positioned on the inner side 322 of the blade 320.

Figure 3C:
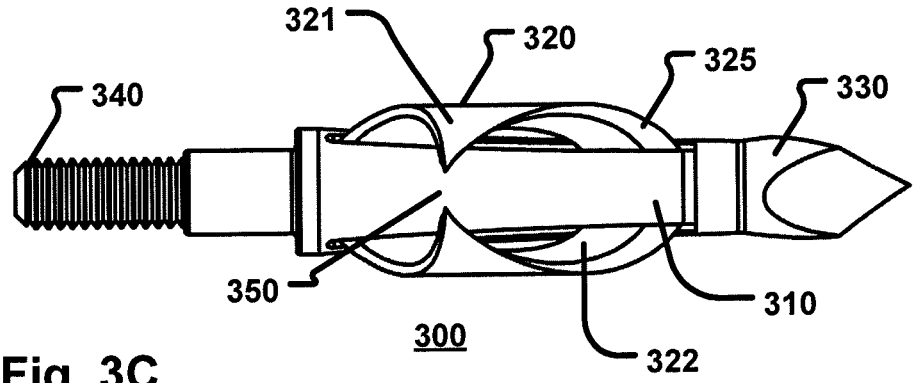
FIG. 3C is a top view of the broadhead according to the third embodiment.
Figure 3D:
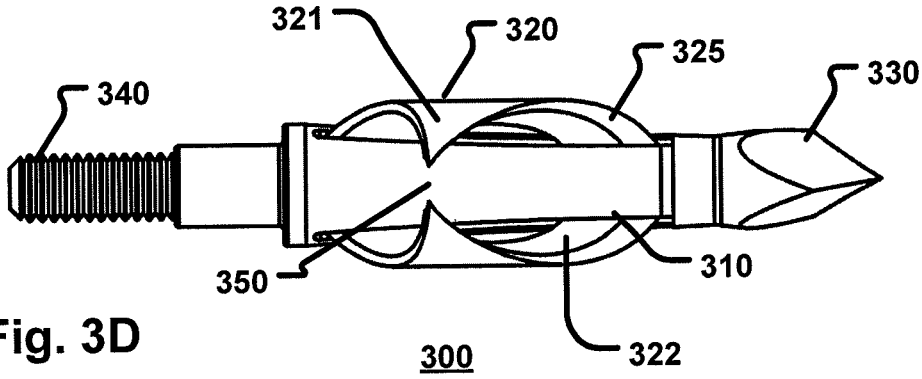
FIG. 3D is a bottom view of the broadhead according to the third embodiment.
Figure 3E:
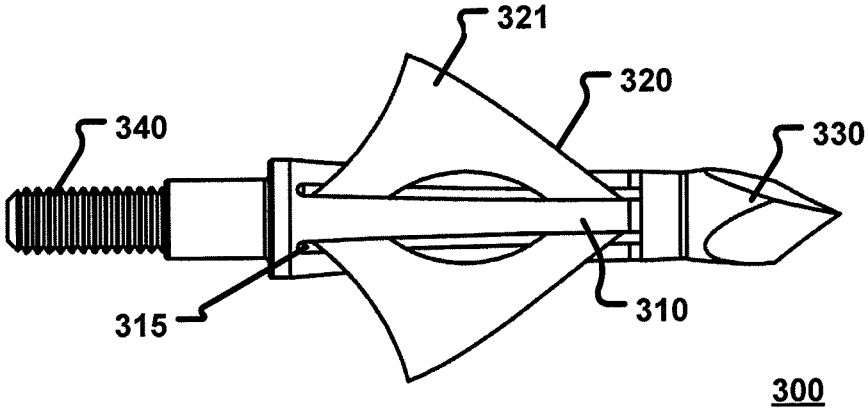
FIG. 3E is a right side view of the broadhead according to the third embodiment.
Figure 3F:
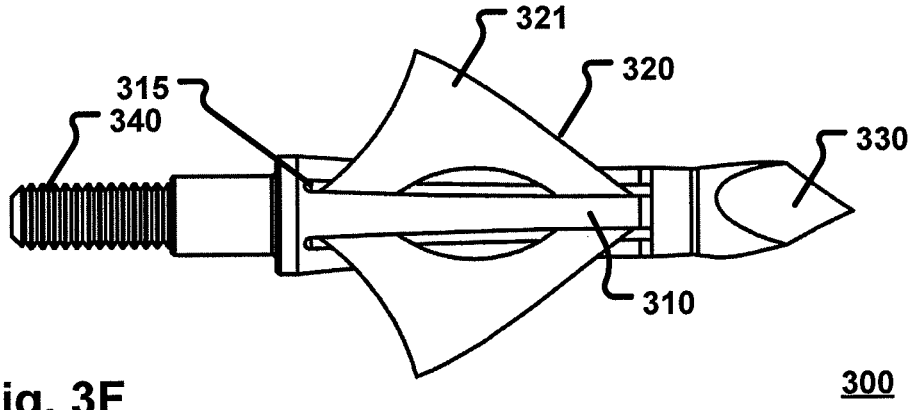
FIG. 3F is a left side view of the broadhead according to the third embodiment.
Figure 3G:
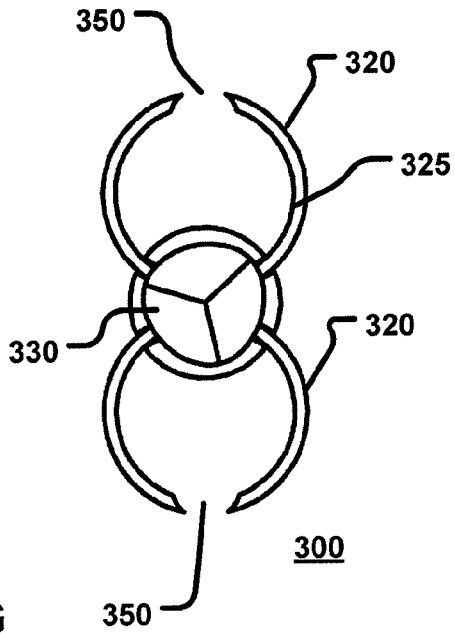
FIG. 3G is a front view of the broadhead according to the third embodiment.
Figure 3H:
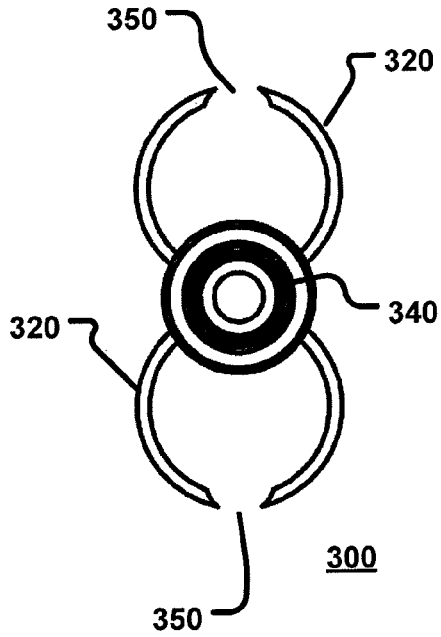
FIG. 3H is a back view of the broadhead according to the third embodiment.

FIGS. 3C-3H illustrate various additional views of the broadhead 300. Specifically, FIG. 3C illustrates a top view of the broadhead 300, FIG. 3D illustrates a bottom view of the broadhead 300, FIG. 3E illustrates a right side view of the broadhead 300, FIG. 3F illustrates a left side view of the broadhead 300, FIG. 3G illustrates a front view of the broadhead 300 and FIG. 3H illustrates a back view of the broadhead 300.

Figure 4A:
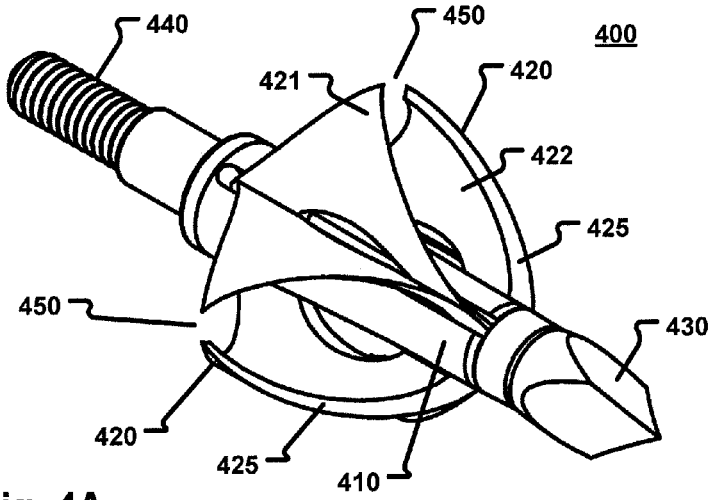
FIG. 4A is an isometric view of a broadhead according to a fourth embodiment of the present disclosure.

FIG. 4A is an isometric view of a broadhead 400 according to a fourth embodiment of the present disclosure. Like broadhead 300 (FIG. 3A), broadhead 400 includes a plurality of blades 420 that extend from a ferrule 410. The blades 420 have an arcuate shape that form a partial circular shape which causes the blades 420 to have an inner side 422 and an outer side 421. The partial circular shape is achieved by including an opening 450 at an arc of each blade 420. According to embodiments, the inner side 422 has a beveled edge 425 that forms the cutting surface of the blades 420. The broadhead 420 includes a tip 430 at a proximate end and threads or other securement means at a distal end 440.

Figure 4B:
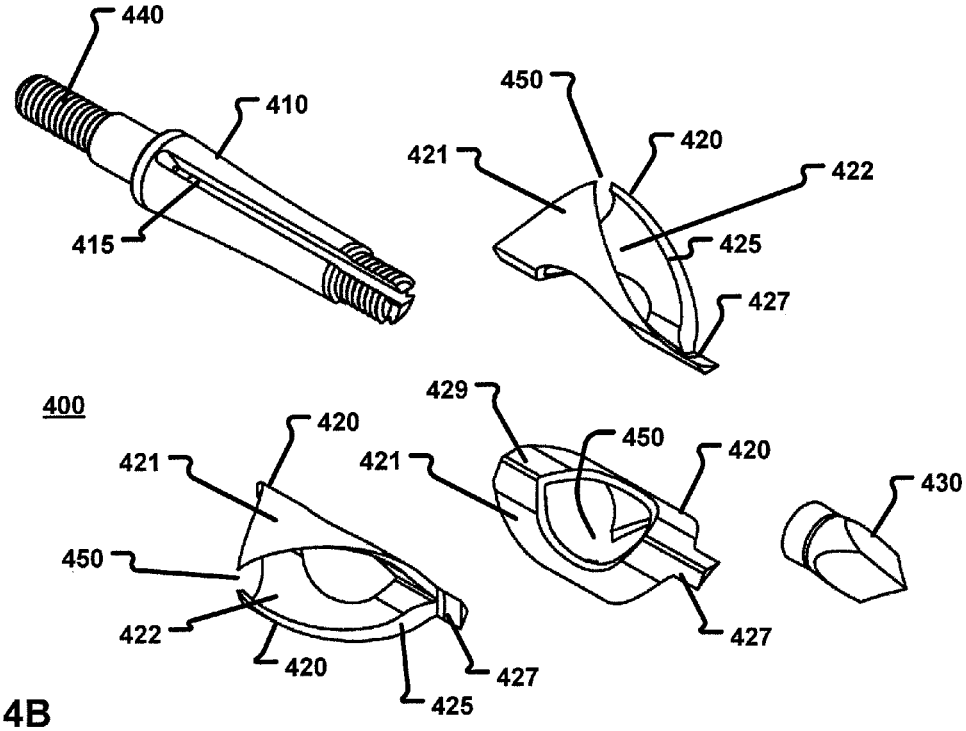
FIG. 4B is an exploded isometric view of the broadhead according to the fourth embodiment.

As shown in FIG. 4B, the broadhead 400 may include three blades 420 with each blade being configured to be inserted and removed from the ferrule 410 by sliding a connecting portion 429 of the blade into one or more slots 415 on the ferrule 410. Once the blades 420 have been inserted into the slots 415, a notch 427 on the blade may be configured to fit within a portion of the tip 430 when the tip has been secured to a proximate end of the ferrule 410 to further secure the blades 420 so as to prevent the blades from moving.

Figure 4C:
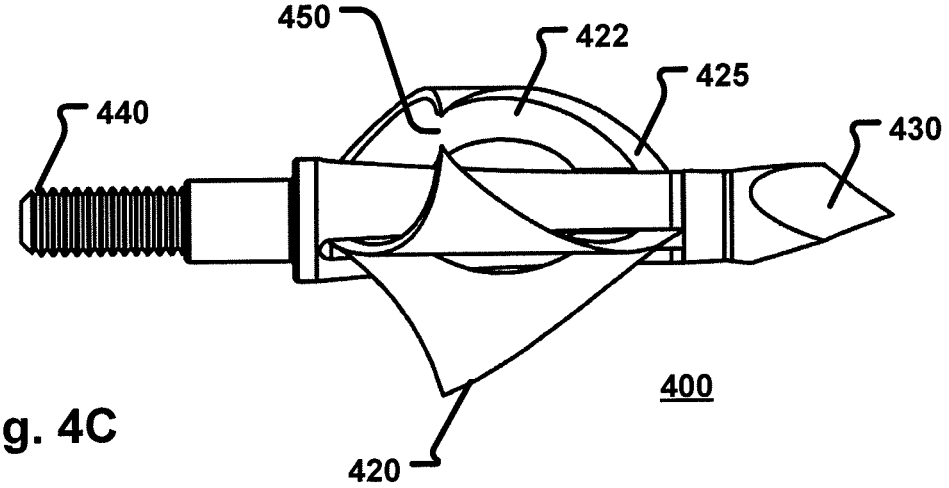
FIG. 4C is a top view of the broadhead according to the fourth embodiment.
Figure 4D:
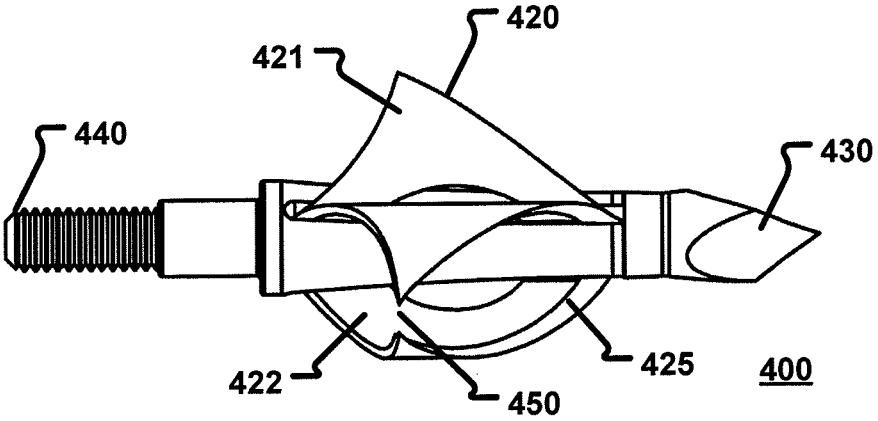
FIG. 4D is a bottom view of the broadhead according to the fourth embodiment.
Figure 4E:
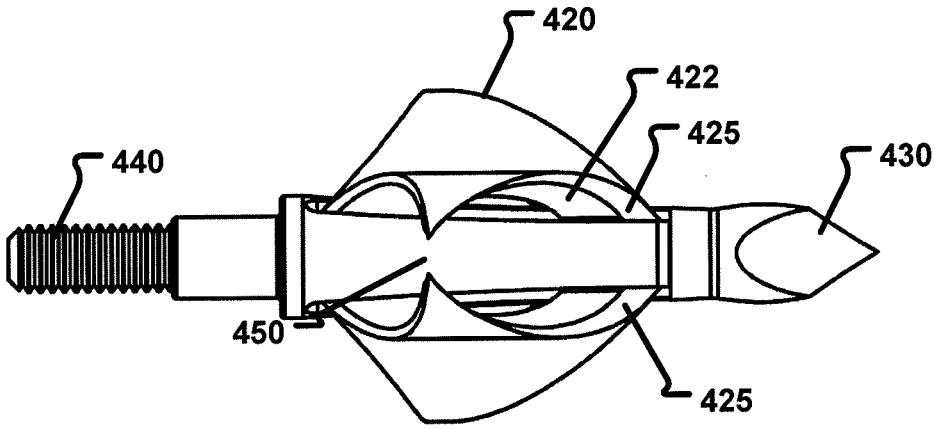
FIG. 4E is a right side view of the broadhead according to the fourth embodiment.
Figure 4F:
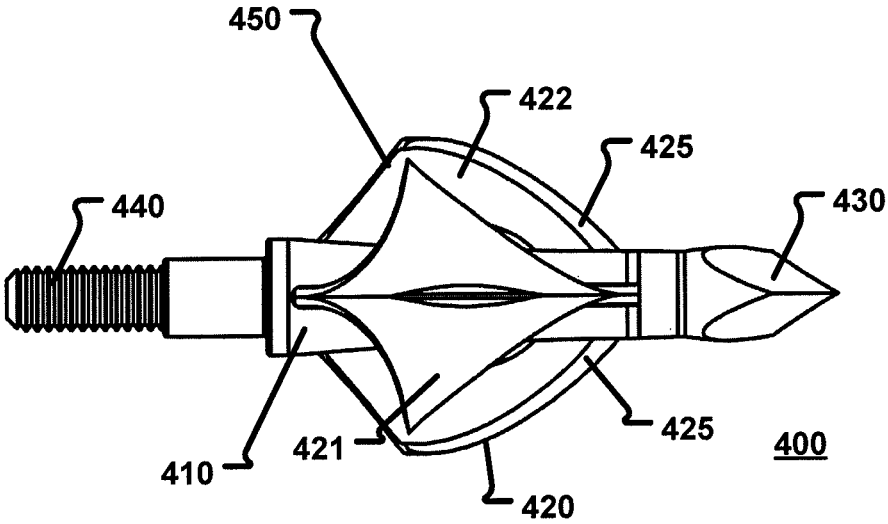
FIG. 4F is a left side view of the broadhead according to the fourth embodiment.
Figure 4G:
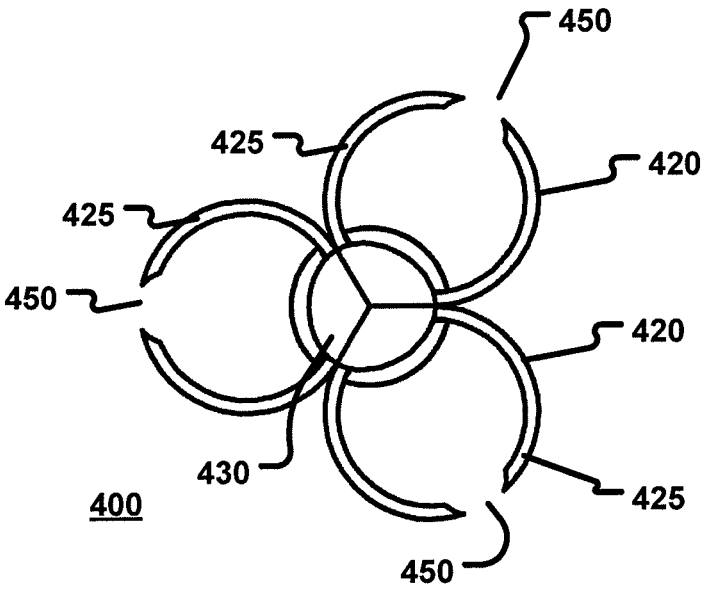
FIG. 4G is a front view of the broadhead according to the fourth embodiment.
Figure 4H:
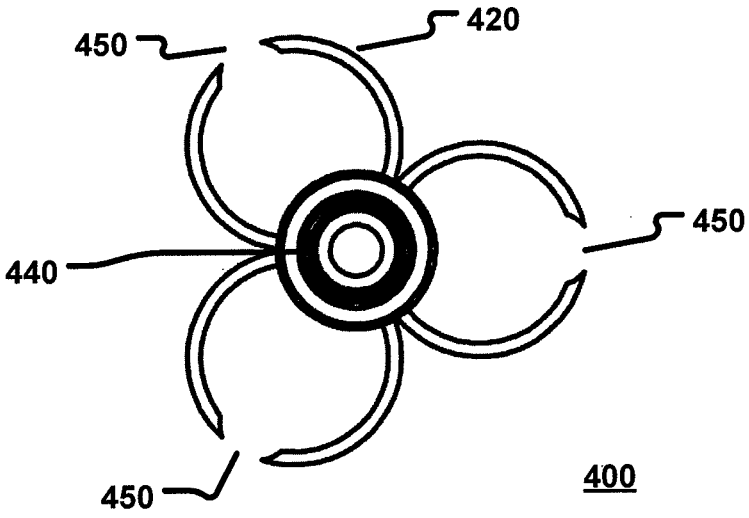
FIG. 4H is a back view of the broadhead according to the fourth embodiment.

FIGS. 4C-4H illustrate various additional views of the broadhead 400. Specifically, FIG. 4C illustrates a top view of the broadhead 400, FIG. 4D illustrates a bottom view of the broadhead 400, FIG. 4E illustrates a right side view of the broadhead 400, FIG. 4F illustrates a left side view of the broadhead 400, FIG. 4G illustrates a front view of the broadhead 400 and FIG. 4H illustrates a back view of the broadhead 400.

Figure 5:
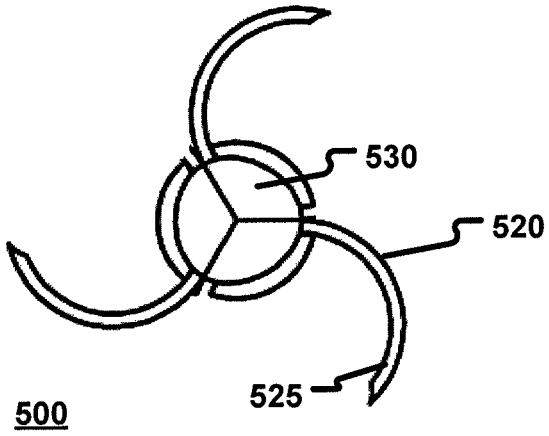
FIG. 5 illustrates a front view of a broadhead according to a fifth embodiment of the present disclosure.

FIG. 5 illustrates a front view of a broadhead 500 according to a fifth embodiment of the present disclosure. As shown in FIG. 5, the broadhead 500 includes a plurality of blades 520 configured in an arcuate shape. However, in contrast to the other embodiments described, the blades of the broadhead 500 are configured in a half circular shape. Although a half circular shape is shown, it is contemplated that the circular shape may be greater than a half circular shape (without completing a full circular shape) or less than a half circular shape. As with the other embodiments described herein, each of the blades 520 include a cutting portion 525 on inner side of the blade 520. In other embodiments, the cutting portion may be on the outer side of the blade 520 as well as both sides (i.e., inner side and outer side) of the blade 520.

As with the other embodiments described herein, the broadhead 500 includes a tip 530 that may be used to secure the blades 520 in their respective positions in embodiments where the blades 520 are removable. In certain embodiments, broadhead 500 includes similar features to those described above with respect to FIGS. 1A-4H.

Figure 6:
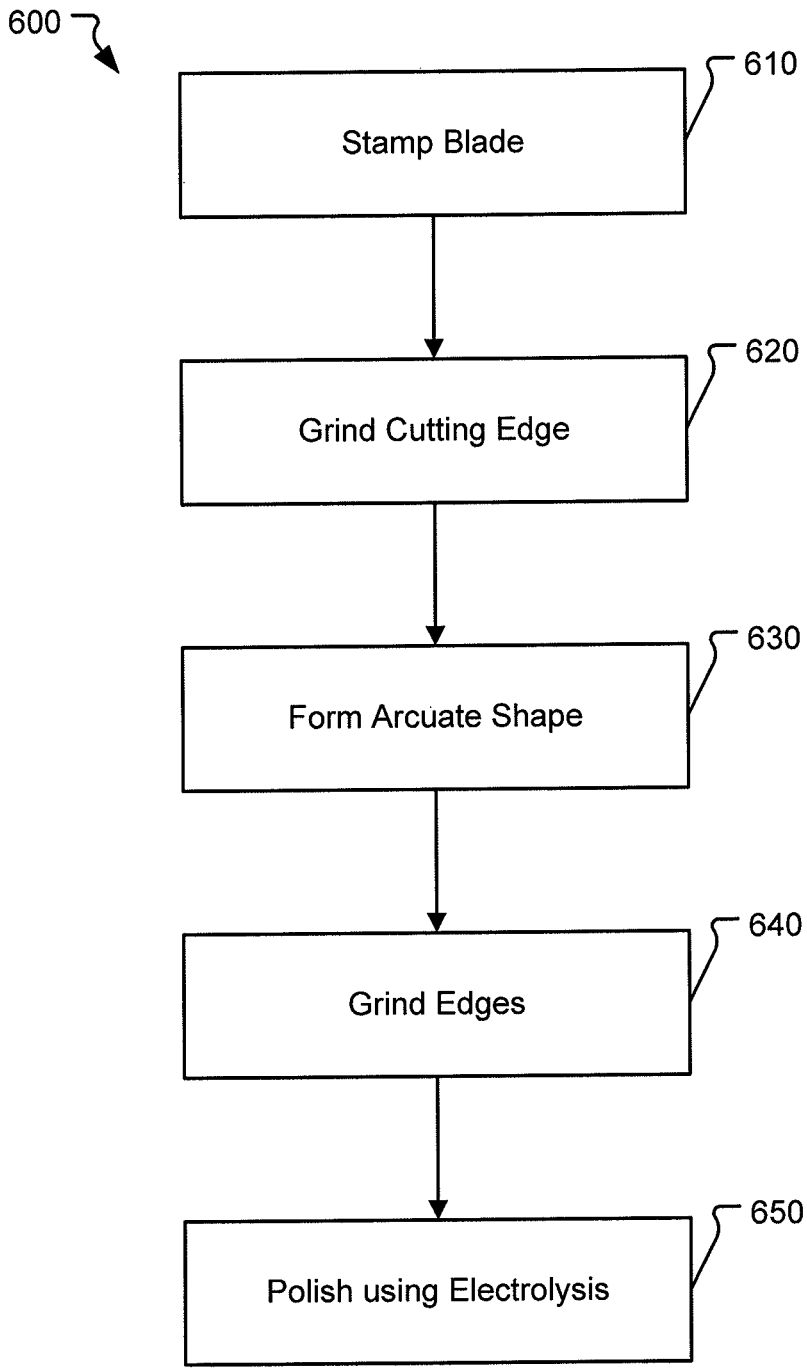
FIG. 6 illustrates a process for forming the arcuate blades of various embodiments described herein.

FIG. 6 illustrates a process 600 for forming the arcuate blades of the embodiments of the broadheads described herein. Process 600 begins at step 610 in which the material is stamped with the shape of the blade. Flow then proceeds to step 620 in which the inner edge (i.e., the edge of the blade that will be the inner edge of the blade when the blade is formed into the arcuate shape) of the blade is grinded to form the cutting edge of the blade. The blade is then formed 630 into the arcuate shape. Flow then proceeds to step 640 in which the bladed is tempered and both sides of the blade are grinded. Flow then proceeds to operation 650 in which the blade, particularly, the grinded cutting portion of the blade, is polished by electrolyzing.

The description and illustration of one or more embodiments provided in this application are not intended to limit or restrict the scope of the claims in any way. However, one skilled in the relevant art may recognize that the embodiments may be practiced without one or more of the specific details, or with other resources, materials, etc. The embodiments, examples, and details provided in this application are considered sufficient to convey possession and enable others to make and use the best mode of the claimed subject matter. The claimed subject matter should not be construed as being limited to any embodiment, example, or detail provided in this application. Regardless of whether shown and described in combination or separately, the various features are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A broadhead comprising:

a body portion having a plurality of slots extending substantially along a length thereof; and a plurality of removable blades having an arcuate shape causing each of the plurality of blades to have an inner side and an outer side, wherein a base portion of each of the plurality of removable blades is configured to be received in respective slots of the plurality of slots and further wherein at least one side of each of the plurality of removable blades has a sharpened edge extending substantially along a front portion of the plurality of removable blades wherein the arcuate shape of each of the plurality of blades forms a complete circle.

2. The broadhead of claim 1, wherein a proximal end of the body portion is configured to attach to a removable tip and wherein a distal end of the body portion is configured to attach to a shaft of an arrow.

3. The broadhead of claim 2, wherein the tip is adapted to secure the plurality of removable blades to the body portion when the tip is received by the body portion.

4. The broadhead of claim 2, wherein at least one of the proximal end of the body portion and the distal end of the body portion is threaded.

5. A broadhead comprising:

a body portion having a plurality of slots extending substantially along a length thereof; and a plurality of removable blades having an arcuate shape causing each of the plurality of blades to have an inner side and an outer side, wherein a base portion of each of the plurality of removable blades is configured to be received in respective slots of the plurality of slots and further wherein at least one side of each of the plurality of removable blades has a sharpened edge extending substantially along a front portion of the plurality of removable blades;

wherein the arcuate shape of each of the plurality of blades forms a half circle.

6. The broadhead of claim 5, wherein a proximal end of the body portion is configured to attach to a removable tip and wherein a distal end of the body portion is configured to attach to a shaft of an arrow.

7. The broadhead of claim 6, wherein the tip is adapted to secure the plurality of removable blades to the body portion when the tip is received by the body portion.

8. The broadhead of claim 6, wherein at least one of the proximal end of the body portion and the distal end of the body portion is threaded.

9. A broadhead comprising:

a body portion having a plurality of slots extending substantially along a length thereof; and a plurality of removable blades having an arcuate shape causing each of the plurality of blades to have an inner side and an outer side, wherein a base portion of each of the plurality of removable blades is configured to be received in respective slots of the plurality of slots and further wherein at least one side of each of the plurality of removable blades has a sharpened edge extending substantially along a front portion of the plurality of removable blades;

wherein the arcuate shape of each of the plurality of blades forms a three-quarter circle.

10. The broadhead of claim 9, wherein a proximal end of the body portion is configured to attach to a removable tip and wherein a distal end of the body portion is configured to attach to a shaft of an arrow.

11. The broadhead of claim 10, wherein the tip is adapted to secure the plurality of removable blades to the body portion when the tip is received by the body portion.

12. The broadhead of claim 10, wherein at least one of the proximal end of the body portion and the distal end of the body portion is threaded.

13. A broadhead comprising:

a body portion having a plurality of blades, wherein each of the plurality of blades have an arcuate shape, wherein at least one side of each of the plurality of blades has a sharpened edge extending substantially along a front side of each of the plurality of blades;

wherein the arcuate shape of each of the plurality of blades forms a complete circle.

14. The broadhead of claim 13, wherein a distal end of the body portion is configured to attach to a shaft of an arrow.

15. The broadhead of claim 14, wherein the distal end of the body portion is threaded.

16. A broadhead comprising:

a body portion having a plurality of blades, wherein each of the plurality of blades have an arcuate shape, wherein at least one side of each of the plurality of blades has a sharpened edge extending substantially along a front side of each of the plurality of blades;

wherein the arcuate shape of each of the plurality of blades forms a half circle.

17. The broadhead of claim 16, wherein a distal end of the body portion is configured to attach to a shaft of an arrow.

18. The broadhead of claim 17, wherein the distal end of the body portion is threaded.

19. A broadhead comprising:

a body portion having a plurality of blades, wherein each of the plurality of blades have an arcuate shape, wherein at least one side of each of the plurality of blades has a sharpened edge extending substantially along a front side of each of the plurality of blades;

wherein the arcuate shape of each of the plurality of blades forms a three-quarter circle.

20. The broadhead of claim 19, wherein a distal end of the body portion is configured to attach to a shaft of an arrow.

21. The broadhead of claim 20, wherein the distal end of the body portion is threaded.

22. A broadhead comprising:

a body portion having a plurality of blades, wherein each of the plurality of blades have an arcuate shape, wherein at least one side of each of the plurality of blades has a sharpened edge extending substantially along a front side of each of the plurality of blades;

wherein each of the plurality of blades have at least two opposing blade portions, wherein the two opposing blade portions arcuately extend from a center portion of each of the plurality to form a rounded portion of the arcuate shape.

23. The broadhead of claim 22, wherein a distal end of the body portion is configured to attach to a shaft of an arrow.

24. The broadhead of claim 23, wherein the distal end of the body portion is threaded.

25. A broadhead comprising:

a body portion; and a plurality of blades extending from the body portion, wherein each of the plurality of blades comprise:

two opposing blade portions extending in opposite directions from a middle portion of each of the plurality of blades, wherein each of the two opposing blade portions arcuately extend toward the other blade portion, and further wherein each of the two opposing blade portions has at least one sharpened edge.

26. The broadhead of claim 25, wherein the two opposing blade portions form a substantially complete circular shape.

27. The broadhead of claim 25, wherein the two opposing blade portions form a complete circular shape.

28. The broadhead of claim 25, wherein the at least one sharpened edge extends at least substantially along proximate edge of each of the two opposing blade portions.

29. The broadhead of claim 25, wherein each of the plurality of blades are removable.

30. The broadhead of claim 25, wherein the body portion includes a removable tip.

* * * * *